US007585331B2

(12) United States Patent
Lai et al.

(10) Patent No.: US 7,585,331 B2
(45) Date of Patent: Sep. 8, 2009

(54) LONG-TERM ANTIBIOTIC AND DEODORANT TEXTILE WITH MESOPOROUS STRUCTURE AND PROCESSING METHOD THEREOF

(75) Inventors: Pui-Leng Lai, Taipei Hsien (TW); Cheng-Chieh Chen, Taipei Hsien (TW); Chun-Hung Lin, Taipei Hsien (TW); Jia-Peng Lin, Taipei Hsien (TW); Nai-Yun Liang, Taipei Hsien (TW)

(73) Assignee: Taiwan Textile Research Institute, Taipei Hsien (TW)

( * ) Notice: Subject to any disclaimer, the term of this patent is extended or adjusted under 35 U.S.C. 154(b) by 300 days.

(21) Appl. No.: 11/419,106

(22) Filed: May 18, 2006

(65) Prior Publication Data

US 2007/0151038 A1 Jul. 5, 2007

(30) Foreign Application Priority Data

Dec. 29, 2005 (TW) ..... 94147283 A

(51) Int. Cl.
*D06M 13/50* (2006.01)
*D06M 11/79* (2006.01)

(52) U.S. Cl. ..... 8/115.6; 8/115.51; 252/8.61; 252/8.81; 252/8.91

(58) Field of Classification Search ..... 8/115.51, 8/115.6; 424/400; 252/8.61, 8.81, 8.91
See application file for complete search history.

(56) References Cited

U.S. PATENT DOCUMENTS 6,630,170 B2 * 10/2003 Balkus et al. ..... 424/489

FOREIGN PATENT DOCUMENTS

TW 595618 6/2004
TW 200533694 10/2005

OTHER PUBLICATIONS

Mahltig, B., et al."Functionalisation of textiles by inorganic sol-gel coatings." Journal of Materials Chemistry (2005), 15, pp. 4385-4398. Published on the web Jul. 8, 2005.*
Kitazawa, N., et al. "Sol-gel derived mesoporous silica films using amphiphilic triblock polymers". Journal of Non-Crystalline Solids (2003), 332, pp. 199-206.*

* cited by examiner

*Primary Examiner*—Lorna M Douyon
*Assistant Examiner*—Amina Khan
(74) *Attorney, Agent, or Firm*—Griffin & Szipl, P.C.

(57) ABSTRACT

A long-term antibiotic and deodorant textile with mesoporous structure and processing method thereof are provided. At first, a textile is dipped into an aqueous solution of a surfactant containing nanoparticles. An aqueous solution of a silicon source is prepared and its pH value is adjusted to about 5~9. Then, the aqueous solution of the surfactant and the aqueous solution of the silicon source are mixed to form a mixture solution. The mixture solution is stirred until silica powder form therein. The textile is taken out and dipped into water and organic solvent separately several times. Finally, the textile is dried to obtain the long-term antibiotic and deodorant textile with mesoporous structure.

9 Claims, No Drawings

LONG-TERM ANTIBIOTIC AND DEODORANT TEXTILE WITH MESOPOROUS STRUCTURE AND PROCESSING METHOD THEREOF

RELATED APPLICATIONS

The present application is based on, and claims priority from, Taiwan Application Serial Number 94147283, filed Dec. 29, 2005, the disclosure of which is hereby incorporated by reference herein in its entirety.

BACKGROUND

1. Field of Invention

The present invention relates to an antibiotic and deodorant textile and processing method thereof. More particularly, the present invention relates to a long-term antibiotic and deodorant textile with mesoporous structure and processing method thereof.

2. Description of Related Art

Textiles with deodorant properties are traditionally processed with active carbon. Although the textiles processed with active carbon have good deodorant properties, the colors of the textiles become darker. Therefore, the active carbon processing method is limited to treat dark colored textiles and is not suited to treat light or brightly colored textiles. Another processing method uses zeolite deodorant properties. Suitable binders are used to adhere the zeolite to textiles. The disadvantages of zeolite processing method are the requirement of binders, the expensive cost and poor wash resistance of the textile.

Textiles with antibiotic properties are traditionally made by adding an organic quaternary ammonium salt or an antiseptic containing silver. In the zeolite processing method previously stated, silver ions can be added to zeolite and the zeolite containing silver ions can be adhered to the surfaces of textiles.

SUMMARY

It is therefore an aspect of the present invention to provide a processing method of a long-term antibiotic and deodorant powder with mesoporous structure. The processing method is simpler, low cost and environmentally friendly. Moreover, it can be used for mass production.

Another aspect of the present invention is to provide a processing method of a long-term antibiotic and deodorant textile with mesoporous structure. The processing method is not limited to dark colored textiles. The processing method can be used on light and brightly colored textiles. Moreover, the processing method is free of binders.

Still another aspect of the present invention is to provide a long-term antibiotic and deodorant textile with mesoporous structure. The long-term antibiotic and deodorant textile with mesoporous structure has great antibiotic and deodorant properties, good hand-feeling and wash fastness.

In accordance with the foregoing aspects, one embodiment of the present invention provides a processing method of a long-term antibiotic and deodorant powder with mesoporous structure. Firstly, an aqueous solution of a surfactant containing nanoparticles is prepared. An aqueous solution of a silicon source is also prepared and the pH value thereof is adjusted to about 5~9. Then, the aqueous solution of the surfactant and the aqueous solution of the silicon source are mixed to form a mixture solution. The mixture solution is stirred until silica powder form therein. The mixture solution is filtered to get the silica powder. The silica powder is washed by water and an organic solvent separately. Finally, the silica powder is dried to obtain the long-term antibiotic and deodorant powder with mesoporous structure. The object of washing the silica powder by the organic solvent is to remove the residual surfactant inside of silica pores.

In accordance with the foregoing aspects, one embodiment of the present invention provides a processing method of a long-term antibiotic and deodorant textile with mesoporous structure. Firstly, a textile is dipped into an aqueous solution of a surfactant containing nanoparticles. An aqueous solution of a silicon source is prepared and the pH value thereof is adjusted to about 5~9. Then, the aqueous solution of the surfactant and the aqueous solution of the silicon source are mixed to form a mixture solution. The mixture solution is stirred until silica powder form therein. The textile is taken out from the mixture solution. The textile is dipped into water and an organic solvent separately several times. Then, the textile is pressed by a roller several times. Finally, the textile is dried to obtain the long-term antibiotic and deodorant textile with mesoporous structure. The object to dip the textile in the organic solvent is to remove the residual surfactant inside of silica pores.

In accordance with the foregoing aspects, one embodiment of the present invention provides a long-term antibiotic and deodorant textile with mesoporous structure, which comprises a textile, mesoporous silica and nanoparticles. The mesoporous silica is lodged in the textile. The pore diameter of the mesoporous silica is about 1~50 nm. The nanoparticles are physically adsorbed on the mesoporous silica. The nanoparticle material is silver, zinc oxide, titanium oxide, copper, nickel or iron.

In conclusion, the invention provides a simple processing method of a long-term antibiotic and deodorant textile with mesoporous structure. The cost of the processing method is cheap and the method is environmentally friendly. The textile processed by this method has great antibiotic and deodorant properties. Moreover, the textile is wash resistance and good hand-feeling properties. Because the original color of textiles will not be changed using this method, the method can be used to process light and brightly colored textile.

DETAILED DESCRIPTION OF THE PREFERRED EMBODIMENTS

Processing Method of a Long-Term Antibiotic and Deodorant Powder with Mesoporous Structure Firstly, an aqueous solution of a surfactant containing nanoparticles is prepared. About 1~10 g of the surfactant is added to 50 ml of water. The water is stirred to properly mix the surfactant. Then, nanoparticles is added therein to from an aqueous solution of the surfactant containing nanoparticles. The surfactant is a tri-block copolymer $(EO)_n(PO)_m(EO)_n$, wherein n is about 5~105 and m is about 30~70. The nanoparticle material is silver, zinc oxide, titanium oxide, copper, nickel or iron. The diameter of the nanoparticles is about 1~50 nm.

An aqueous solution of a silicon source is also prepared. About 5~50 g of the silicon source is added to 300 ml of water. The water is stirred to properly mix the silicon source. The pH value of the aqueous solution of the silicon source is adjusted to about 5~9 by adding sulfuric acid or sodium hydroxide. The silicon source is tetraethoxysilane, sodium silicate or aluminum silicate.

The aqueous solution of the surfactant and the aqueous solution of the silicon source are mixed to form a mixture solution. The concentration of the surfactant in the mixture solution needs to be higher than the critical micelle concentration. Therefore, the surfactant can form micelle in the mixture solution. In the structure of the micelle, hydrophilic groups are on the outer side and hydrophobic groups are on the inner side. The structure of the micelle facilitates the silicon source to deposit thereon to from silica with a mesoporous structure. In a preferred embodiment, the concentration of the surfactant in the mixture solution is about 0.0008~0.0012 M. The weight ratio of the surfactant, the nanoparticles, the silicon source and the water in the mixture solution is about 1:0.002~0.2:5~40:50~300.

The mixture solution is stirred until silica powder formed therein. The mixture solution is filtered to get the silica powder. The silica powder is washed by water and an organic solvent separately. The object of washing the silica powder by the organic solvent is to remove the surfactant inside silica pores. In a preferred embodiment, the organic solvent is alcohol. In a more preferred embodiment, the alcohol is methanol, ethanol, propyl alcohol or butyl alcohol.

Finally, the silica powder is put in an oven to be dried at a temperature of 80° C. to obtain the long-term antibiotic and deodorant powder with mesoporous structure. The silica powder can also be dried by other ways, such as air-drying or calcining.

Table 1 is a list comparing specific surface area and pore diameters of the antibiotic and deodorant powder. The surfactant used here is a tri-block copolymer $(EO)_n(PO)_m(EO)_n$, wherein n is about 13 and m is about 30. In table 1, the powder with a higher specific surface area has a larger surface area to absorb more odors and is expected to have better deodorant ability. The pore diameter of silica is about 23 angstrom. The added nanoparticles affect the pore diameter of the silica. In table 1, the pore diameters of the antibiotic and deodorant powder are about 20~30 angstrom.

TABLE 1 a list comparing specific surface area and pore diameters of the antibiotic and deodorant powder.

| Sample | Specific surface area ($m^2/g$) | Pore diameter (angstrom) |
|---|---|---|
| Silica | 521 | 23 |
| Silica with silver nanoparticles | 276 | 29 |
| Silica with zinc oxide nanoparticles | 706 | 26 |
| Silica with titanium oxide nanoparticles | 795 | 25 |

Processing Method of a Long-Term Antibiotic and Deodorant Textile with Mesoporous Structure Firstly, an aqueous solution of a surfactant containing nanoparticles and an aqueous solution of a silicon source are prepared as previously stated. A textile is dipped in the aqueous solution of the surfactant containing nanoparticles. Then, the aqueous solution of the silicon source is added and mixed with the aqueous solution of the surfactant containing nanoparticle to from a mixture solution. The mixture solution is stirred until silica powder formed therein. Then, the textile is taken out from the mixture solution. The textile is pressed to remove residual water and to increase wash resistance. The pressing step forces silica to lodge in the textile. The textile is dipped into water and an organic solvent separately several times. Then, the textile is pressed by a roller several times. The object of the textile to dip in an organic solvent several times is to remove the residual surfactant inside of silica pores. Finally, the textile is put in an oven to be dried at a temperature of 90° C. for 30 minutes to obtain the long-term antibiotic and deodorant textile with mesoporous structure. The textile can also be dried by air.

Deodorant Test

The deodorant test was based on the deodorant standard of the Japanese Association for the Functional Evaluation of Textiles (JAFET). A five-liters gas sampling bag was filled with three liters of 100 ppm standard ammonia. A sample with an area of 100 $cm^2$ was then put in the gas sampling bag. The concentration of the ammonia was measured by an ammonia gas detector tube after 1 hour.

TABLE 2 deodorant test of cotton textiles of silica containing nanoparticles

| Sample | Ammonia concentration after a hour (ppm) | Deodorant rate (%) |
|---|---|---|
| Comparison group | 100 | 0 |
| Cotton textile | 60 | 40 |
| Cotton textile of silica containing silver nanoparticles | 40 | 60 |
| Cotton textile of silica containing zinc oxide nanoparticles | 8 | 92 |
| Cotton textile of silica containing titanium oxide nanoparticles | 18 | 82 |

In the comparison group, nothing was put in the gas sampling bag and the test result of the comparison group was used to be compared by the results of the other sample. In table 2, the cotton textile processed by the method of the invention has great deodorant ability. Especially, the deodorant rate of the sample containing zinc oxide nanoparticles is up to 92%.

Antibiotic Test

The antibiotic test was based on the antibiotic standard of JAFET. When the bacteriostasis value is larger than 2.2, test samples have a bacteriostasis effect. When the bactericidal value is larger than 0, test samples have a bactericidal effect. In table 2, the cotton textiles of silica containing nanoparticles generally have better antibiotic properties than the cotton textile of silica without containing nanoparticles, which indicates that the addition of nanoparticles increases the antibiotic ability of the textiles. Among the nanoparticles, the addition of silver nanoparticles shows the best effect, the addition of zinc oxide is second. The addition of titanium oxide also has good antibiotic effects after being ultraviolet light illuminated.

TABLE 3 antibiotic test of cotton textiles of silica containing nanoparticles

| Test item | | Test sample: Cotton textile of silica | Cotton textile of silica containing silver nanoparticles | Cotton textile of silica containing zinc oxide nanoparticles | Cotton textile of silica containing titanium oxide nanoparticles |
|---|---|---|---|---|---|
| *Staphylococcus aureus* | Bacteriostasis value | 3.64 | >5.76 | >5.76 | 4.3 |
| | Bactericidal value | 0.73 | >2.85 | >2.85 | 2.5 |
| *Klebsiella Pneumoniae* | Bacteriostasis value | 1.44 | >6.22 | 5.20 | >5.8 |
| | Bactericidal value | <0 | >3.08 | 2.05 | >3.1 |

Wash Resistance Test

The wash resistance test was based on the wash test method standard of AATCC 135. The cotton textile of silica containing zinc oxide nanoparticles was separately tested by a deodorant test and an antibiotic test after being washed by the water for twenty times. Results are shown in Table 4 and table 5. The cotton textile of the silica containing zinc oxide nanoparticles still has a deodorant rate of 72% after being washed twenty times. Moreover, the antibiotic property of the cotton textile of silica containing zinc oxide doesn't change after being washed.

TABLE 4 deodorant test of cotton textiles of silica containing zinc oxide nanoparticles after being washed for twenty times

| Sample | Ammonia concentration after a hour (ppm) | Deodorant rate (%) |
|---|---|---|
| Comparison group | 100 | 0 |
| Cotton textile | 60 | 40 |
| Cotton textile of silica containing zinc oxide nanoparticles | 28 | 72 |

TABLE 5 antibiotic test of cotton textiles of silica containing zinc oxide nanoparticles after being washed for twenty times

| Test item | | Test sample Cotton textile of silica containing zinc oxide nanoparticles |
|---|---|---|
| *Staphylococcus aureus* | Bacteriostasis value | 5.8 |
| | Bactericidal value | 3.1 |
| *Klebsiella Pneumoniae* | Bacteriostasis value | 6.3 |
| | Bactericidal value | 2.9 |

Accordingly, the present invention has the following advantages.

(1) The processing method is simpler, lower cost and environmentally friendly. Moreover, it can be used in mass production.

(2) The original colors of the textiles will not be affected by the processing method. Therefore, the processing method can be used on light and brightly colored textiles.

(3) The processing method is free of binder.

(4) The long-term antibiotic and deodorant textile with mesoporous structure has great antibiotic and deodorant properties, good hand-feeling and wash fastness.

The preferred embodiments of the present invention described above should not be regarded as limitations to the present invention. It will be apparent to those skilled in the art that various modifications and variations can be made to the present invention without departing from the scope or spirit of the invention. The scope of the present invention is as defined in the appended claims.

What is claimed is:

1. A method of forming a long-term antibiotic and deodorant textile with mesoporous silica powder, comprising the steps of:

dipping a textile into an aqueous solution of a surfactant containing nanoparticles;

preparing an aqueous solution of a silicon source and adjusting the pH value thereof to about 5-9;

mixing the aqueous solution of the surfactant and the aqueous solution of the silicon source to form a mixture that includes the textile;

stirring the mixture until the mesoporous silica powder is formed therein, wherein the nanoparticles are adsorbed in the mesoporous silica powder;

taking the textile out of the mixture;

pressing the textile to remove residual water and to lodge the mesoporous silica powder in the textile without using a binder;

dipping the textile into water and an organic solvent separately to remove surfactant that is inside mesopores of the mesoporous silica powder;

pressing the textile by a roller; and drying the textile to obtain the long-term antibiotic and deodorant textile with mesoporous silica powder.

2. The method of claim 1, wherein the concentration of the surfactant in the mixture solution is about 0.0008-0.0012M.

3. The method of claim 1, wherein the organic solvent is alcohol.

4. The method of claim 3, wherein the alcohol is selected from the group consisting of methanol, ethanol, propyl alcohol and butyl alcohol.

5. The method of claim 1, wherein the surfactant is a tri-block copolymer (EO)n(PO)m(EO)n, wherein n is about 5-105and m is about 30-70and wherein EO is ethylene oxide and PO is propylene oxide.

6. The method of claim 1, wherein the nanoparticles comprise a material selected from the group consisting of silver, zinc oxide, titanium oxide, copper, nickel and iron.

7. The method of claim 1, wherein the diameter of the nanoparticles is about 1 nm to ~50 nm.

8. The method of claim 1, wherein the weight ratio of the surfactant, the nanoparticles, the silicon source and the water in the mixture is about 1:0.002-0.2:5-40:50-300.

9. The method of claim 1, wherein the silicon source is selected from the group consisting of tetraethoxysilane, sodium silicate and aluminum silicate.

* * * * *